United States Patent [19]

Miyama et al.

[11] Patent Number: 4,804,887

[45] Date of Patent: Feb. 14, 1989

[54] DISPLAY DEVICE WITH VIBRATION-PREVENTING PLATE FOR LINE CATHODES

[75] Inventors: Hiroshi Miyama, Yokahama; Yoshikazu Kawauchi, Kawasaki; Kaoru Tomii, Isehara; Jun Nishida, Tokyo, all of Japan

[73] Assignee: Matsushita Electrical Industrial Co., Ltd., Osaka, Japan

[21] Appl. No.: 124,428

[22] Filed: Nov. 18, 1987

[30] Foreign Application Priority Data

| | | | |
|---|---|---|---|
| Nov. 19, 1986 | [JP] | Japan | 61-275969 |
| Apr. 17, 1987 | [JP] | Japan | 62-95620 |
| Jul. 17, 1987 | [JP] | Japan | 62-179477 |
| Jul. 24, 1987 | [JP] | Japan | 62-186160 |

[51] Int. Cl.[4] ..... H01J 63/02; H01J 19/12

[52] U.S. Cl. ..... 313/495; 313/422; 313/269

[58] Field of Search ..... 313/422, 269, 495, 411

[56] References Cited

U.S. PATENT DOCUMENTS

| | | | |
|---|---|---|---|
| 3,783,327 | 1/1974 | Adams, Jr. | 313/269 X |
| 3,922,578 | 11/1975 | Wilson | 313/343 X |
| 4,341,980 | 7/1982 | Noguchi et al. | 313/495 X |
| 4,714,863 | 12/1987 | Yokoyama et al. | 313/269 X |

*Primary Examiner*—Palmer C. DeMeo

*Attorney, Agent, or Firm*—Lowe, Price, LeBlanc, Becker & Shur

[57] ABSTRACT

A display device includes line cathodes. Separate first electrodes extend in rear of the line cathodes. A second electrode extends in front of the line cathodes and has apertures for guiding electron beams from the line cathodes. The apertures of the second electrode correspond to the separate first electrodes and the line cathodes. A third electrode deflects the electron beams. A screen is exposed to the electron beams. A vibration-preventing plate extends along the line cathodes and has apertures corresponding to the separate first electrodes and the line cathodes. The portions of the vibration-preventing plate between the apertures of the plate are in contact with the line cathodes.

49 Claims, 10 Drawing Sheets

DISPLAY DEVICE WITH VIBRATION-PREVENTING PLATE FOR LINE CATHODES

BACKGROUND OF THE INVENTION

This invention relates to a display device, and specifically relates to a flat-type cathode-ray tube display device.

Some flat-type cathode-ray tube display devices include a plurality of parallel line cathodes producing respective electron beams, and a screen exposed to the electron beams and converting them into corresponding lights. A plurality of parallel control grid electrodes disposed between the line cathodes and the screen modulate the levels of beam current of the respective electron beams in accordance with display data. Also, there are several groups of other grid electrodes, vertical scanning electrodes, and beam deflecting and focusing electrodes.

In general, the line cathodes tend to vibrate. Vibrations of the line cathodes adversely affecting the electron beams, reducing a quality of reproduced images on the screen.

SUMMARY OF THE INVENTION

It is an object of this invention to provide a display device which ensures a high quality of reproduced images.

In a display device according to a first aspect of this invention, separate first electrodes extend in rear of line cathodes. A second electrode extends in front of the line cathodes and has apertures for guiding electron beams from the line cathodes. The apertures of the second electrode correspond to the separate first electrodes and the line cathodes. A third electrode deflects the electron beams. A screen is exposed to the electron beams. A plate extend along the line cathodes and has apertures corresponding to the separate first electrodes and the line cathodes. The portions of the plate between the apertures of the plate are in contact with the line cathodes.

In a display device according to a second aspect of this invention, there are first electrodes and a second electrode. Line cathodes extend between an array of the first electrodes and the second electrode. A vibration-preventing plate contacts the line cathodes and supports the line cathodes to prevent vibrations of the line cathodes. The vibration-preventing plate has projections in contact with the line cathodes.

In a display device according to a third aspect of this invention, line cathodes extend in a vertical direction and are spaced along a horizontal direction. Elongated vertical scanning electrodes extend in the horizontal direction and are spaced along the vertical direction. The vertical scanning electrodes extend in rear of the line cathodes. A grid electrode extends in front of the line cathodes and has apertures for guiding electron beams from the line cathodes. A vibration-preventing plate has apertures corresponding to the apertures of the grid electrode. The portions of the vibration-preventing plate between the apertures of the plate are in contact with the line cathodes. A horizontal deflection electrode extends in front of the grid electrode and deflects the electron beams. A light emitting layer extends on an inner surface of a faceplate and is exposed to the electron beams.

In a display device according to a fourth aspect of this invention, a cathode emits electrons. An electron beam is derived from the electrons emitted by the cathode. The electron beam is converted into a corresponding light. A mechanism prevents vibration of the cathode.

DESCRIPTION OF THE PREFERRED EMBODIMENTS

Prior to the detailed description of this invention, a previously proposed display device of the flat cathode-ray tube type will be described with reference to FIGS. 1–6 for a better understanding of this invention.

Figure 1:
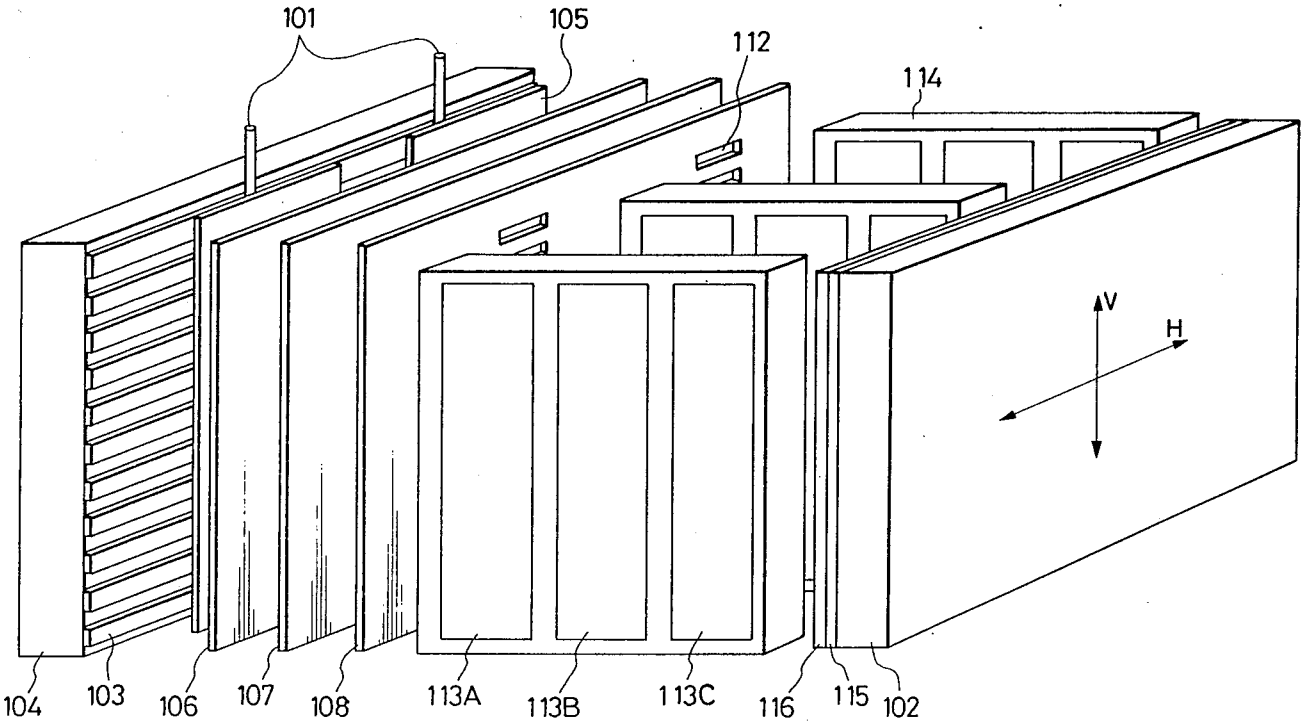
FIG. 1 is a perspective view of a previously proposed display device.
Figure 2:
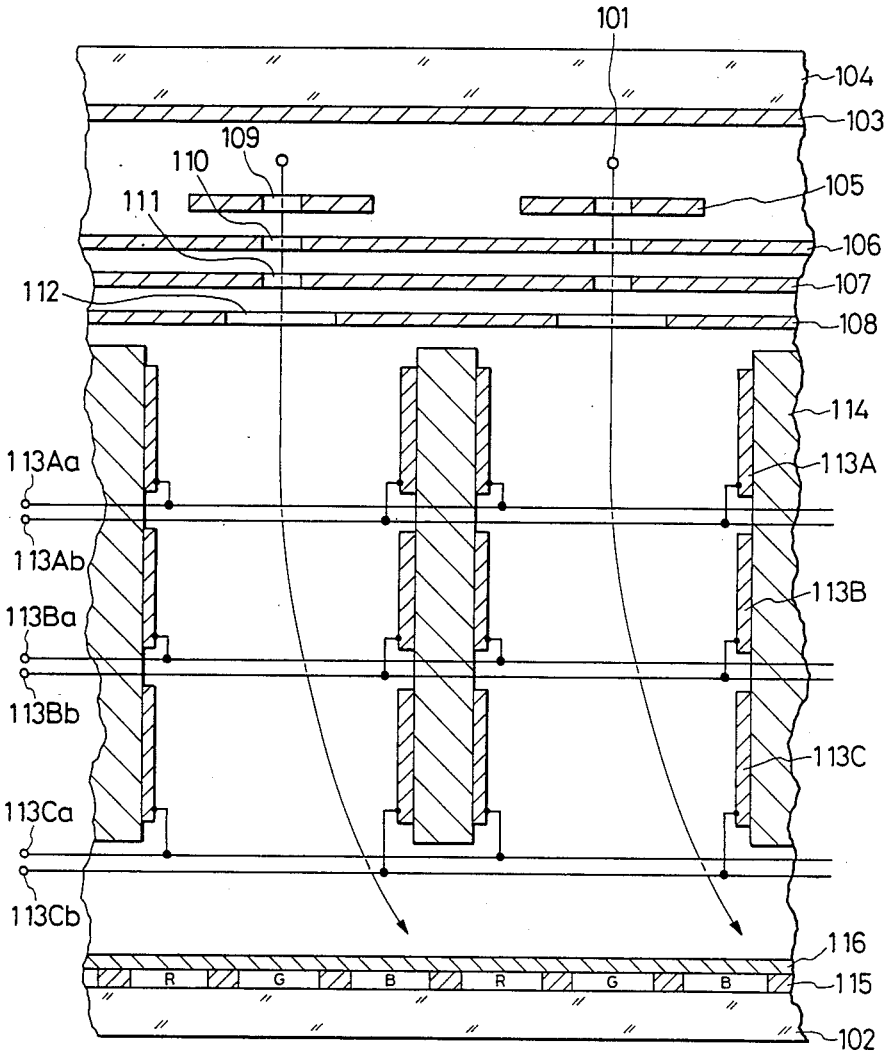
FIG. 2 is a sectional view of the display device of FIG. 1.

FIGS. 1 and 2 show a flat-type cathode-ray tube display device including a vacuum enclosure, e.g., a glass vessel, part of which is omitted from the drawings for greater clarity in describing the internal elements. Generally, such a display device is used to indicate characters, images, and others when oriented as shown in FIG. 1, in which the horizontal direction is denoted by an arrow H and the vertical direction is denoted by an arrow V, and this arbitrarily selected orientation will be assumed throughout the following description.

As shown in FIGS. 1 and 2, the display device includes a plurality of parallel line cathodes 101, each consisting of an elongated linear filament which can be formed for example of tungsten wire coated with a suitable oxide material. The line cathodes 101 are oriented vertically, and arrayed at regular intervals along the horizontal direction. The number of the line cathodes 101, and the intervals between the line cathodes 101 are chosen arbitrarily. For example, in the case of a 10-inch screen, 20 line cathodes 101 having a length of about 160 mm are spaced at equal intervals of about 10 mm. The line cathodes 101 serve to emit electrons which form beams directed toward a faceplate 102 respectively.

A supporting plate 104, is formed of an electrically insulating material, is disposed closely adjacent to the array of the line cathodes 101 on the opposite side of the line cathodes 101 to the faceplate 102. The supporting plate 104 is secured to the vacuum enclosure. The supporting plate 104 can be composed of a portion of the vacuum enclosure. A set of vertical scanning electrodes 103 formed upon the inner surface of the supporting plate 104 face the line cathodes 101. The vertical scanning electrodes 103 are mutually electrically separate, and are each of a horizontally-extending narrow elongated shape and are successively arrayed at regular spacings along the vertical direction. The number of the vertical scanning electrodes 103, in the case of a cathode ray tube for displaying a broadcast television signal, generally equals the number of horizontal scanning lines (which is 480 in the NTSC system for example). The number of the vertical scanning electrodes 103 may equal to the number of horizontal scanning lines divided by an arbitrary natural number.

First grid electrodes 105, which will be referred to as the G1 electrodes, are in the form of plates and extend between the array of the line cathodes 101 and the faceplate 102. The G1 electrodes 105 extent vertically and are spaced at regular intervals along the horizontal direction. The G1 electrodes 105 are close to and parallel to the line cathodes 101 respectively. Each of the G1 electrodes 105 has apertures 109 regularly arranged in a vertical row and corresponding to or essentially aligning with the related line cathode 101. The apertures 109 in each of the G1 electrodes 105 correspond to or essentially align with the vertical scanning electrodes 103 respectively. The G1 electrodes 105 are subjected to display data or video signals, modulating the electron beams in accordance with the display data or video signals respectively.

A second grid electrode 106, which will be referred to as the G2 electrode, immediately succeeds the G1 electrodes 105 along the electron beam path. The G2 electrode 106 takes the form of a single plate and extends parallel to the G1 electrodes 105. The G2 electrode 106 has apertures 110 at positions corresponding to the positions of the apertures 109 in the G1 electrodes 105. The G2 electrode 106 serves to derive electron beams from the electrons emitted by the line cathode 101.

A third grid electrode 107, which will be referred to as the G3 electrode, immediately succeeds the G2 electrode 106 along the electron beam path. The G3 electrode 107 takes the form of a single plate and extends parallel to the G2 electrode 106. The G3 electrode 107 has apertures 111 at positions corresponding to the positions of the apertures 110 in the G2 electrode 106. The G3 electrode 107 serves to shield the beam-generating electric field produced by the G2 electrode 106 from electric fields which are produced by electrodes subsequently disposed along the electron beam path.

A fourth grid electrode 108, which will be referred to as the G4 electrode, immediately succeeds the G3 electrode 107 along the electron beam path. The G4 electrdoe 108 takes the form of a single plate and extends parallel to the G3 electrode 107. The G4 electrode 108 has apertures 112 at positions corresonding to the positions of the apertures 111 in the G3 electrode 107. Each of the apertures 112 in the G4 electrode 108 preferably has a horizontal dimension substantially greater than its vertical dimension.

A plurality of horizontal deflection electrodes formed of elongated vertically aligned layers which are arranged as three sets, designated by reference characters 113A, 113B, and 113C respectively, between the G4 electrode 108 and the faceplate 102. The horizontal deflection electrodes 113A–113C fixedly extend on opposite side surfaces of vertically-extending support members 114 made of insulating material which are positioned at regular spacing along the horizontal direction. The positions of the support members 114 are midway between the positions of respective pairs of the adjacent line cathodes 101 as seen in the direction perpendicular to both the horizontal direction H and the vertical direction V. The horizontal deflection electrodes 113A–113C are formed on the support members 114 by plating, vacuum deposition, or the like. Alternating ones of the set of the horizontal deflection electrodes 113A are connected to respective ones **113A*a* and 113A*b* of a pair of bus leads. Similarly, alternating ones of the set of the horizontal deflection electrodes 113B are connected to respective ones 113B*a* and 113B*b* of a pair of bus leads, and alternating ones of the set of the horizontal deflection electrodes 113C are connected to respective ones 113C*a* and 113C*b* of a pair of bus leads. Voltages are applied to the horizontal deflection electrodes 113A–113C** so as to horizontally deflect and focus the electron beams.

A light emitting layer formed on an inner surface of the faceplate 102 includes a phosphor layer 115 and a metal back electrode 116. The phosphor layer 115 is made up of sequential red-emissive, green-emissive, and blue-emissive stripes or dots R, G, and B.

In operation, drive currents are passed through the line cathodes 101 to heat them and thereby enable electron emission. Voltages are applied to the vertical scanning electrodes 103, the G1 electrodes 105, and the G2 electrode 106 respectively. The voltages applied to the vertical scanning electrodes 103 and the G1 electrodes 105 are roughly similar to the potential of the line cathodes 101. The voltage applied to the G2 electrode 106 is higher than the potential of the line cathodes 101. For example, the voltage applied to the G2 electrode 106 is in the range of 100 to 500 V. This setting of the voltages or potentials at the line cathodes 101 and the electrodes 103, 105, and 106 allows the emitted electrons to move away from the line cathodes 101 toward the G3 electrode 107 through the apertures 109 and 110 in the G1 electrodes 105 and the G2 electrode 106. The electrons moving through the apertures 109 in the G1 electrodes 105 form respective electron beams. The potential at the G1 electrodes 105 determines the amounts of beam current of these electron beams. The potential at the G1 electrodes 105 are varied with the video signal, so that the electron beams are modulated with the video signal.

The electron beam, after emerging from the G2 electrode 106, sequentially passes through the corresponding apertures 111 and 112 in the G3 electrode 107 and the G4 electrode 108, and the three sets of the horizontal deflection electrodes 113A–113C. Voltages of predetermined levels are applied to the electrodes 107, 108, and 113A–113C, which result in the electron beam being focused to form a small spot of suitable size on the phosphor layer 115. Beam focusing in the vertical direction is implemented by an electrostatic lens formed at outlet ends of the apertures 112 in the G4 electrode 108. Horizontal beam focusing is performed by an electrostatic lens formed between the three sets of the horizontal deflection electrodes 113A–113C. The voltages applied to the horizontal deflection electrodes 113A–113C via the bus leads **113A*a*–113C*b* contain horizontal focusing components and horizontal deflection components. The horizontal deflection voltages take a waveform such as a sawtooth waveform or a stepwise-varying waveform having a horizontal scanning period. The application of the horizontal deflection voltages to the horizontal deflection electrodes 113A–113C produces horizontal deflection of the electron beam through a predetermined displacement. The deflected electron beam acts on the phosphor layer 115, allowing light emission from the phosphor layer 115. When the electron beam is entering the red, green, and blue stripes or dots, R, G, and B, the G1 electrodes 105** are subjected to red, green, and blue video signals respectively.

Figure 3:
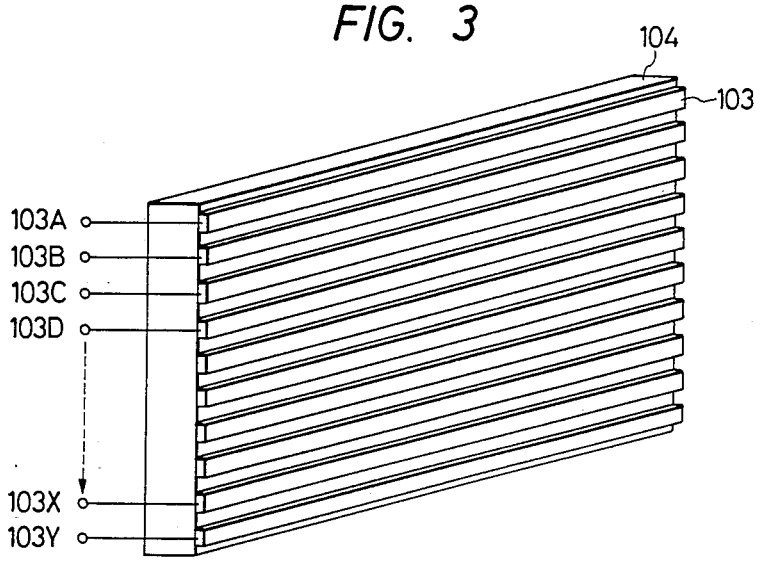
FIG. 3 is a perspective view of the vertical scanning electrodes of FIGS. 1 and 2.
Figure 4:
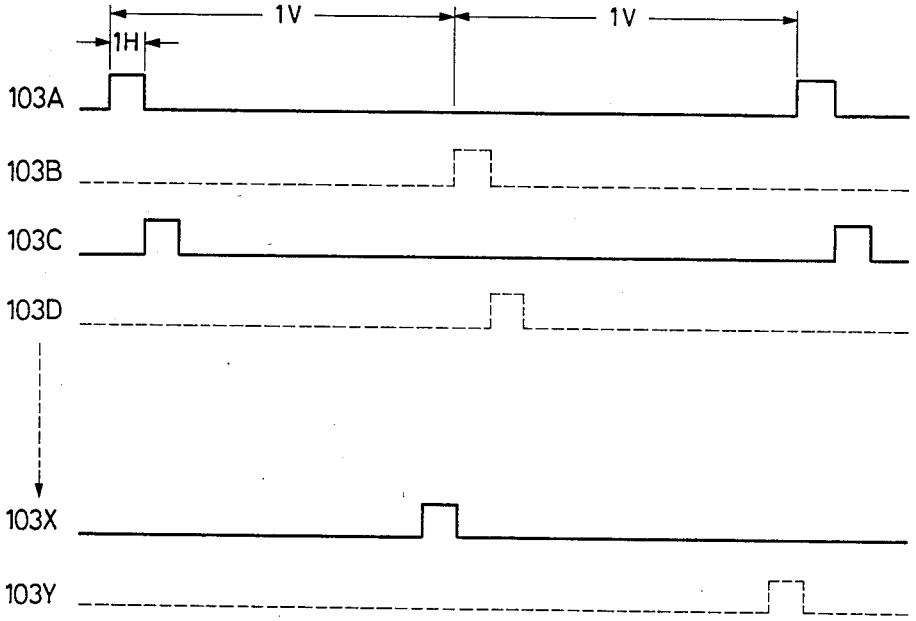
FIG. 4 is a diagram showing waveforms of drive pulses applied to the vertical scanning electrodes of FIGS. 1–3.

The vertical scanning process will be described with reference to FIGS. 1–4. Variations in the voltages at the electrodes of FIG. 3 are indicated by the waveforms of FIG. 4 in which the same reference characters are used to denote the waveforms of the voltages at the corresponding electrodes. Since the vertical scanning electrodes 103 (103A–103Y in FIG. 3) are positioned in close proximity to the line cathodes 101, the polarity of the voltage applied to the vertical scanning electrodes 103 serves to selectively decrease and increase the potential of the space surrounding each line cathode 101 below and above the potential of the line cathode 101 and thereby to selectively enable and inhibit the emission of electron beams. A level of the voltage applied to the vertical scanning electrodes 103 which enables the electron beam emission will be referred to as an enabling voltage, while a corresponding voltage level which inhibits the electron beam emission will be referred to as a cut-off voltage. As the array of the vertical scanning electrodes 103 is closer to the array of the line cathodes 101, smaller enabling and cut-off voltages can produce desired control of the electron beam emission. Vertical scanning is performed by successively applying the enabling voltage to each of the vertical scanning electrodes 103 (103A–103Y in FIG. 3) during one horizontal scanning interval 1H, with the other vertical scanning electrodes being subjected to the cut-off voltage. It will be assumed that interlaced scanning is to be performed. During a first field corresponding to a period IV, alternate vertical scanning electrodes 103A, 103C, ..., 103X are successively exposed to the enabling voltage for respective horizontal scanning intervals 1H. During a second field corresponding to a period 1V, other alternate vertical scanning electrodes 103B, 103D, ..., 103Y are successively exposed to the enabling voltage for respective horizontal scanning intervals 1H.

Figure 5:
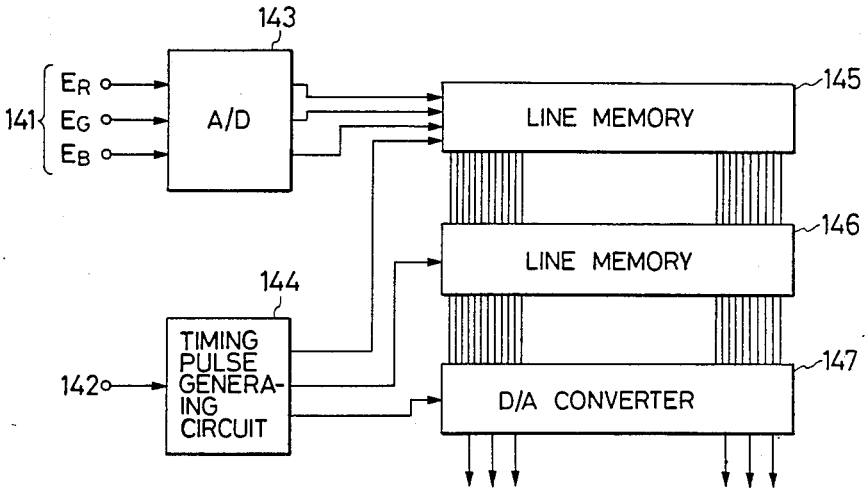
FIG. 5 is a block diagram of a signal processing circuit used with the display device of FIGS. 1 and 2.

Processing of the video signals applied to the G1 electrodes 105 will be described with reference to FIGS. 5 and 6. As shown in FIG. 5, a video signal processing circuit includes a timing pulse generating circuit 144 which produces timing pulses at timings based on those of a television sync signal applied to an input terminal 142. An analog-to-digital (A/D) converter 143 receives an original video signal composed of three demodulated primary color signals (denoted by the characters $E_R$, $E_G$, and $E_B$). The A/D converter 143 derives digital signals from these primary color signals through analog-to-digital conversion. The resultant digital signal data for one horizontal scanning interval (referred to as a 1H interval) is stored sequentially in a line memory 145, at timings determined by timing pulses from the generator 144. When data for a complete horizontal scanning line has been stored in the line memory 145, the data is transferred simultaneously in parallel to a second line memory 146. Signals for the next 1H interval then begin to be successively stored in the first line memory 145. The data thus stored in the second line memory 146 is held therein during a 1H interval, during which the data is applied in parallel to a digital-to-analog (D/A) converter or pulse-width modulator 147 to be converted back into analog signal form or into pulse-width modulated signals. These analog signals are amplified and applied to the respective G1 electrodes 105 to modulate the electron beams in accordance with the display data represented by the video signal. It can be understood that the line memories 145 and 146 are used for time axis conversion.

Figure 6:
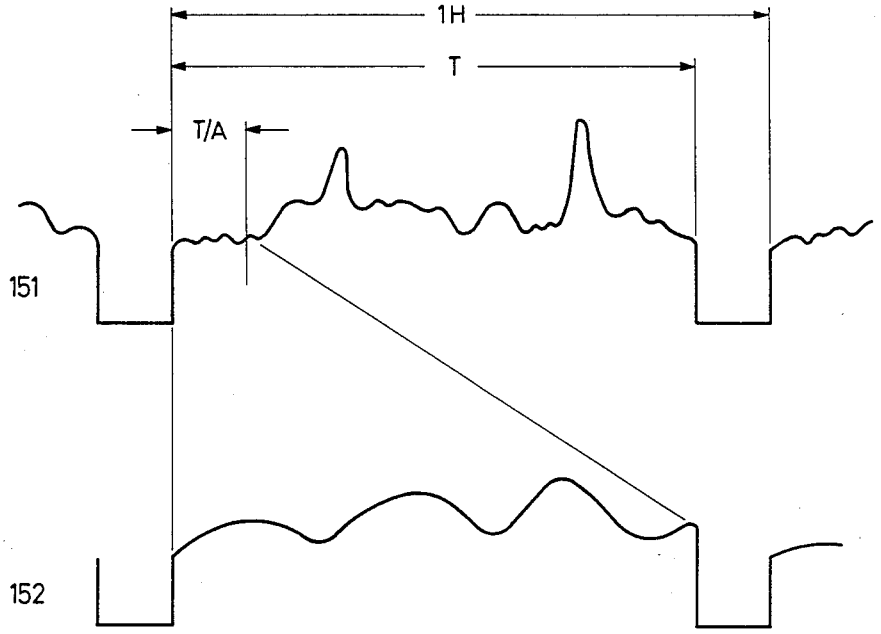
FIG. 6 is a diagram showing waveforms of signals appearing in the signal processing circuit of FIG. 5.

As shown in FIG. 6, during a 1H interval, a video signal 151 is present for an interval T. The interval T is divided into portions having equal lengths T/A, where the character A denotes the number of electron beams or the number of the line cathodes 101. The part of the video signal occurring for each of the portions of the interval T is extended in time axis by a factor equal to the number A so that the resultant extended part 152 of the video signal is present for the interval T. The extended parts 152 of the video signals are applied to the respective G1 electrodes 105.

Figure 7:
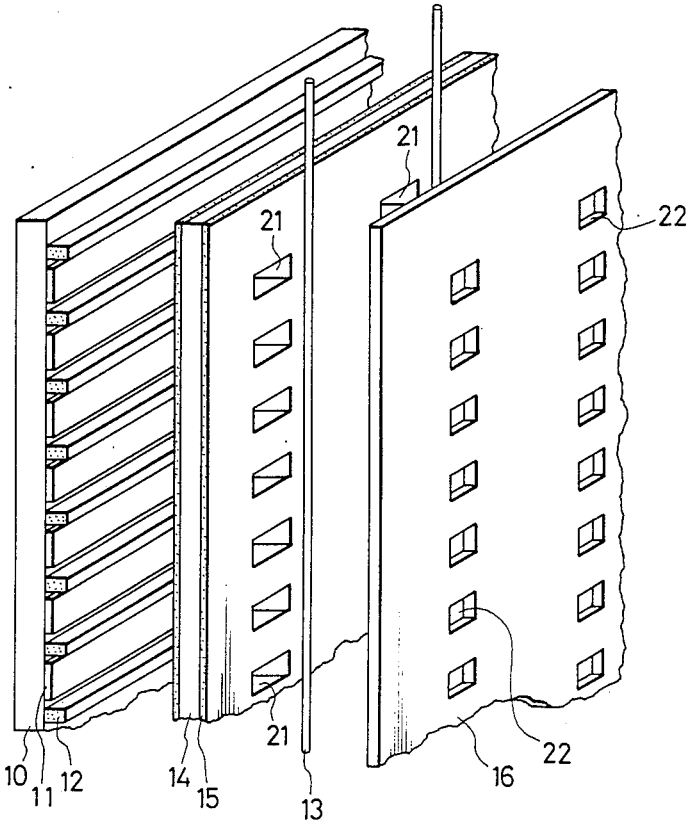
FIG. 7 is a perspective view of part of a display device according to a first embodiment of this invention.

FIG. 7 shows a display device according to a first embodiment of this invention. As shown in FIG. 7, the display device includes a support member 10 made of insulating material. The support member 10 is preferably composed of a glass plate secured to a vacuum enclosure of the display device. The support member 10 can be composed of part of the vacuum enclosure. Vertical scanning electrodes 11 fixed to a surface of the support member 10 extend in the horizontal direction and are spaced at regular intervals along the vertical direction. Protective layers 12 made of insulating material and fixed to the surface of the support member 10 extend horizontally between the vertical scanning electrodes 11. A vibration-preventing plate 14 secured to the vacuum enclosure of the display device extends between the array of the vertical scanning electrodes 11 and an array of line cathodes 13. Opposite surfaces of the vibration-preventing plate 14 are coated with layers 15 of insulating material. As will be made clear hereinafter, this plate 14 prevents the line cathodes 13 from vibrating and also prevents the vertical scanning electrodes 11 from short-circuiting. The vibration-preventing plate 14 has apertures 21 regularly arranged in vertical and horizontal rows. The positions of the vertical rows of the apertures 21 correspond to the positions of the line cathodes 13 respectively. The positions of the horizontal rows of the apertures 21 correspond to the positions of the vertical scanning electrodes 11 respectively. The apertures 21 in the vibration-preventing plate 14 ensure reliable propagation of electric fields between the vertical scanning electrodes 11 and the line cathodes 13. Each of the line cathodes 13 consists of an elongated linear filament which can be formed, for example, of tungsten wire coated with a suitable oxide material. A G1 electrode 16 extends between the array of the line cathodes 13 and a faceplate (not shown in FIG. 7). The G1 electrode 16 has an array of apertures 22 through which electron beams are guided from the line cathodes 13 towards the faceplate. It should be noted that the G1 electrode 16 may replaced by separate G1 electrodes of FIGS. 1 and 2.

During manufacture, first, the vertical scanning electrodes 11 and the protective layers 12 are formed on the support member 10. The vertical scanning electrodes 11 are composed of electrically-conductive transparent films, metal films, or the like. The protective layers 12 are made of insulating substance such as $SiO_2$, $Al_2O_3$, or glass frit. The protective layers 12 have a thickness greater than the thickness of the vertical scanning electrodes 11 so that the protective layers 12 project from the array of the vertical scanning electrodes 11 toward the vibration-preventing plate 14. The protective layers 12 are formed by photoetching, vacuum deposition, or screen printing. Secondly, the vibration-preventing plate 14 is disposed in position. The apertures 21 in the vibration-preventing plate 14 are formed by photoetching. The vibration-preventing plate 14 is preferably composed of a metal plate whose all surfaces are coated with the layers 15 of insulating substance such as $SiO_2$, $Al_2O_3$, or glass frit. The vibration-preventing plate 14 may be composed of a board of insulating material. Thirdly, the line cathodes 13 are disposed in positions where they contact the insulating layer 15 of the vibration-preventing plate 14. One end of the line cathode 13 are fixed with respect to the vacuum enclosure of the display device. The other ends of the line cathodes 13 are pulled by springs (not shown) supported on the vacuum enclosure of the display device. Then, the G1 electrode 16 is disposed in position where the G1 electrode 16 is separate from the array of the line cathodes 13 by a predetermined distance. Spacers (not shown) having structures similar to the structure of the plate 14 maintain the predetermined distance between the G1 electrode 16 and the array of the line cathodes 13. The G1 electrode 16 is preferably composed of a metal plate. The apertures 22 in the G1 electrode 16 are formed by photoetching.

Figure 8:
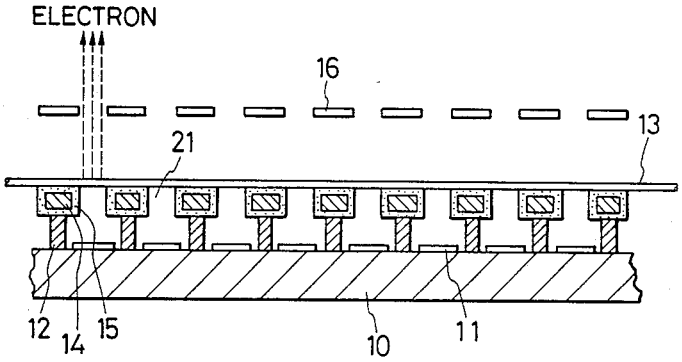
FIG. 8 is a sectional view of the display device of FIG. 7.

As shown in FIG. 8, the protective layers 12 extend between the vertical scanning electrodes 11. The thickness of the protective layers 12 is greater than the thickness of the vertical scanning electrodes 11 so that the protective layers 12 project from the array of the vertical scanning electrodes 11. The protective layers 12 have a vertical dimension smaller than the vertical intervals between the apertures 21 in the vibration-preventing plate 14. End faces of the protective layers 12 contact the vibration-preventing plate 14. The inner surface of the vibration-preventing plate 14 defining the apertures 21 are also coated with layers 15 of insulating material. The line cathodes 13 contact the insulating layer 15 on the vibration-preventing plate 14. The combination of the protective layers 12 and the vibration-preventing plate 14 supports the line cathodes 13 on the support member 10 to prevent vibrations of the line cathodes 13.

In general, when the line cathodes 13 are driven and heated, Ba vaporized from the line cathodes 13. The protective layers 12 and the insulating layers 15 on the vibration-preventing plate 14 protect electrical isolations between the vertical scanning electrodes 11 from the vaporized Ba.

The protective layers 12 may be composed of metal films electrically insulated from the vertical scanning electrodes 11. The coats of the oxide material may be previously removed from the portions of the line cathodes 13 which will meet the vibration-preventing plate 14.

Other portions of the display device according to the first embodiment of this invention are smililar to those of the display device of FIGS. 1–6.

Figure 9:
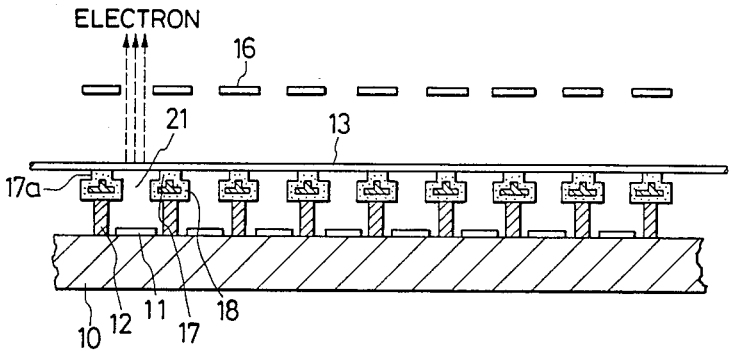
FIG. 9 is a sectional view of part of a display device according to a second embodiment of this invention.

FIG. 9 shows a second embodiment of this invention which is similar to the embodiment of FIGS. 7 and 8 except that a vibration-preventing plate 17 has projections **17*a* coated with layers 18 of insulating material and contacting the line cathodes 13. The projections 17*a* have a vertical dimension smaller than the largest vertical intervals between the apertures 21 in the vibration-preventing plate 17 so that the total area of the surfaces of the line cathodes 13 in contact with the vibration-preventing plate 17 is smaller than that in the display device of FIG. 7 and 8. This smaller contacting area reduces a loss of heat from the line cathodes 13. The height of the projections 17*a*** is preferably in the range of 1 to 100 micrometers.

Figure 10:
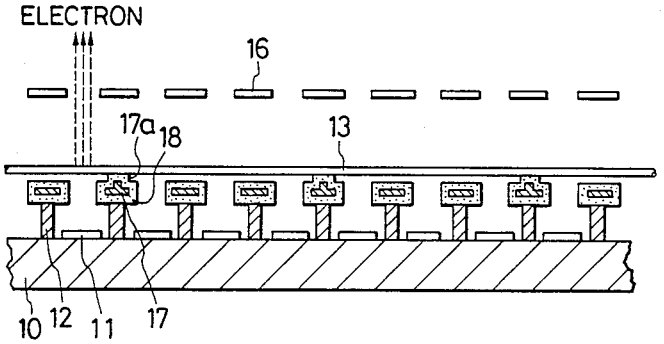
FIG. 10 is a sectional view of part of a display device according to a third embodiment of this invention.

FIG. 10 shows a third embodiment of this invention which is similar to the embodiment of FIG. 9 except that the number of projections **17*a* on the vibration-preventing plate 17 is reduced relative to that in the display device of FIG. 9. Specifically, the pitch of the projections 17*a* equals the pitch of the vertical scanning electrodes 11** multiplied by a given number.

Figure 11:
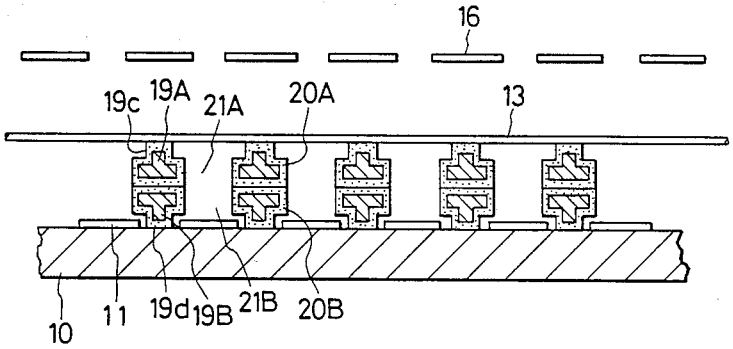
FIG. 11 is a sectional view of part of a display device according to a fourth embodiment of this invention.

FIG. 11 shows a fourth embodiment of this invention which is similar to the embodiment of FIGS. 7 and 8 except for design changes indicated hereinafter.

As shown in FIG. 11, a pair of vibration-preventing plates 19A and 19B extend between the support member 10 and the array of the line cathodes 13. The vibration-preventing plates 19A and 19B are preferably composed of metal cores coated with layers 20A and 20B of insulating material respectively. The first vibration-preventing plate 19A has projections **19*c* coated with the insulating layers 20A and contacting the line cathodes 13. The projections 19*c* have a vertical dimension smaller than the largest vertical intervals between apertures 21A in the first vibration-preventing plate 19A. The second vibration-preventing plate 19B has projections 19*d* coated with the insulating layers 20B and contacting the support member 10. The projections 19*d* have a vertical dimension smaller than the largest vertical intervals between apertures 21B in the second vibration-preventing plate 19B. The projections 19*d* extend between the vertical scanning electrodes 11. The first and second vibration-preventing plates 19A and 19B have similar shapes and oppose each other. The vibration-preventing plates 19A and 19B** are mutually in contact and are secured to a vacuum enclosure of the display device.

The combination of the vibration-preventing plates 19A and 19B supports the line cathodes 13 on the support member 10 and prevents vibrations of the line cathodes 13. In addition, the combinations of the vibration-preventing plates 19A and 19B maintains electrical isolations between the vertical scanning electrodes 11.

It should be noted that the projections **19*c* may be omitted from the first vibration-preventing plate 19A so as to make the related surfaces of the plate 19A** flat.

Figure 12:
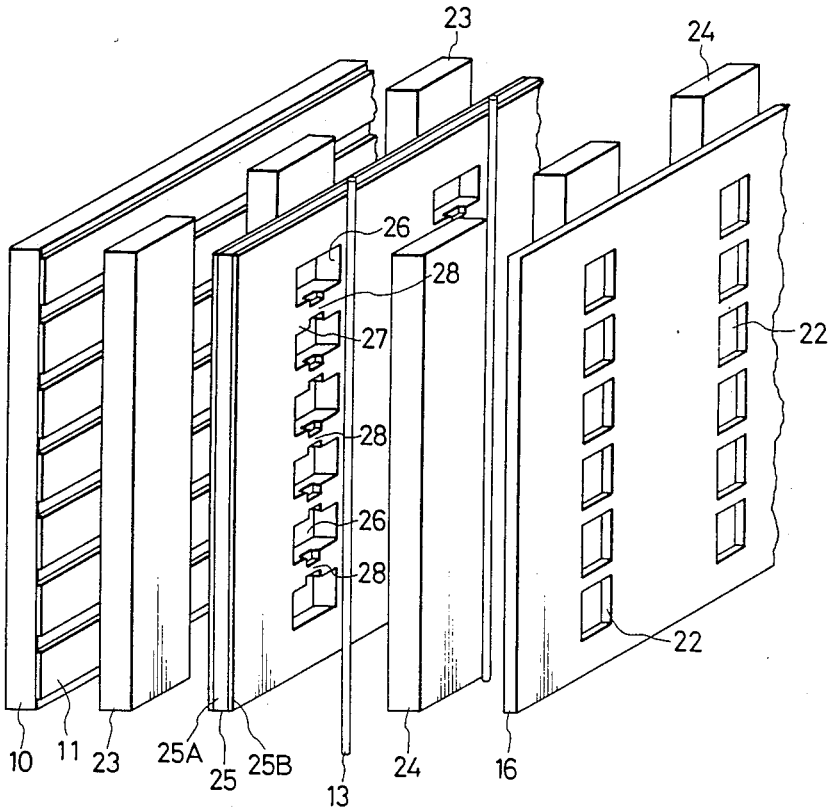
FIG. 12 is a perspective view of a part of a display device according to a fifth embodiment of this invention.
Figure 13:
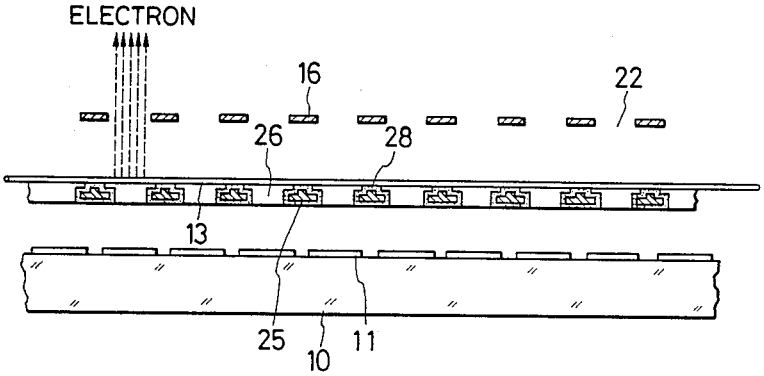
FIG. 13 is a sectional view of the display device of FIG. 12.
Figure 14:
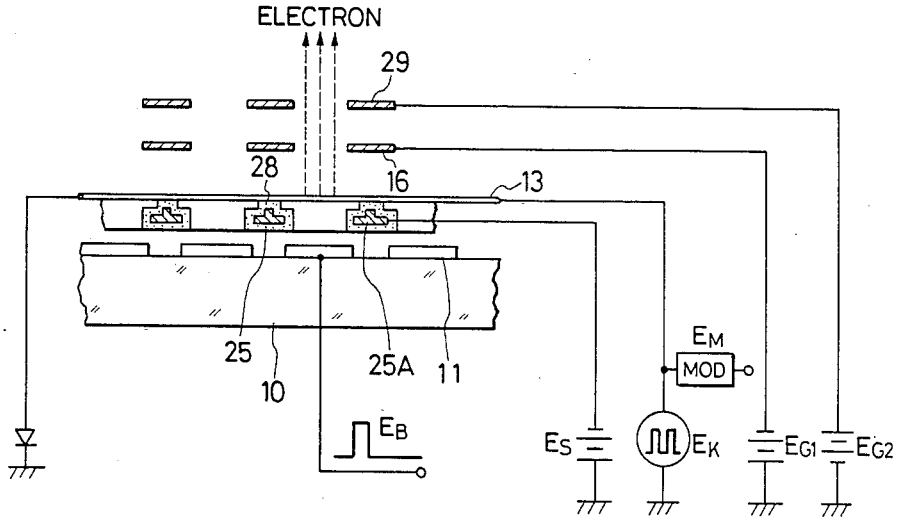
FIG. 14 is a diagram of electrical connections in the display device of FIGS. 12 and 13.

FIGS. 12, 13, and 14 show a display device according to a fifth embodiment of this invention. As shown in FIGS. 12 and 13, the display device includes a support member 10 made of insulating material. The support member 10 is preferably composed of a glass plate secured to a vacuum enclosure of the display device. The support member 10 can be composed of part of the vacuum enclosure. Vertical scanning electrodes 11 fixed to a surface of the support member 10 extend in the horizontal direction and are spaced at regular intervals along the vertical direction. The vertical scanning electrodes 11 are composed of electrically-conductive transparent films or metal films formed by screen printing, photoetching, or other methods. Line cathodes 13 extend vertically and are spaced at regular intervals along the horizontal direction. The line cathodes 13 are pulled and urged by springs (not shown). A vibration-preventing plate 25 and spacers 23 are disposed between the array of the vertical scanning electrodes 11 and the array of the line cathodes 13. The vibration-preventing plate 25 is secured to the vacuum enclosure of the display device. The spacers 23 determine the distance between the array of the vertical scanning electrodes 11 and the array of the line cathodes 13. The spacers 23 extend vertically in regions corresponding to the regions between the line cathodes 13. The vibration-preventing plate 25 has apertures 26 regularly arranged in vertical and horizontal rows. The positions of the vertical rows of the apertures 26 correspond to the positions of the line cathodes 13 respectively. The positions of the horizontal rows of the apertures 26 correspond to the positions of the vertical scanning electrodes 11 respectively. The apertures 26 in the vibration-preventing plate 25 ensure reliable propagation of electric fields between the vertical scanning electrodes 11 and the line cathodes 13. The vibration-preventing plate 25 has a metal core 25A formed with the apertures 26 by photoetching. After the photoetching process, all surfaces of the metal core are coated with layers 25B of insulating substance such as $SiO_2$ or $Al_2O_3$. The vibration-preventing plate 25 has bridges 27 between the apertures 26. The bridges 27 are formed with steps by a half etching process, the steps opposing the line cathodes 13. The steps reduce widths of the bridges 27. The portions of the bridges 27 between the steps form support section 28. The line cathodes 13 are in contact with the support sections 28 and are supported by these sections 28. Each of the line cathodes 13 consists of an elongated linear filament which can be formed, for example, of tungsten wire coated with a suitable oxide material. A G1 electrode 16 extends between the array of the line cathodes 13 and a faceplate (not shown in FIGS. 12–14). The G1 electrode 16 has an array of apertures 22 through which electron beams are guided from the line cathodes 13 toward the faceplate. It should be noted that the G1 electrode 16 may replaced by separate G1 electrodes of FIG. 1 and 2. Spacers 24 extending between the array of the line cathodes 13 and the G1 electrode 16 determines a distance between the array of the line cathodes 13 and the G1 electrode 16.

Since the line cathodes 13 are supported on the vibration-preventing plate 25 via the support sections 28, the line cathodes 13 are prevented from vibrating. The steps in the bridges 27 reduce the contacting areas between the line cathodes 13 and the protective plate 25, decreasing a loss of heat from the line cathodes 13.

The apertures 26 in the vibration-preventing plate 25 may be tapered, each having a wide portion near the line cathodes 13 and a narrow portion near the vertical scanning electrodes 11. The vibration-preventing plate 25 may be disposed between the array of the line cathodes 13 and the G1 electrode 16. The spacers 23 may be replaced by insulating members directly formed on the vertical scanning electrodes 11 or the vibration-preventing plate 25. The vibration-preventing plate 25 may be directly formed on the vertical scanning electrodes 11 or the G1 electrode 16 to omit the spacers 23 or the spacers 24. The vibration-preventing plate 25 may be composed of a board of insulating material such as ceramic or glass. The pitch of the support sections 28 may be equal to the pitch of the vertical scanning electrodes 11 multiplied by a preset number.

As shown in FIG. 14, a G2 electrode 29 succeeds the G1 electrode 16 along the advance direction of electron beams. The vertical scanning electrodes 11 are subjected to pulse voltages EB respectively which allow the electron beams to be directed toward the G2 electrode 29. Drive pulse voltages EK are applied to the line cathodes 13 to heat the line cathodes 13. Modulated signals EM representing display data are also applied to the line cathodes 13. A bias voltage EG1 applied to the G1 electrode 16 makes the electron beam quantities or rates constant. A voltage EG2 applied to the G2 electrode 29 allows electrons to move from the line cathodes 13 toward the G2 electrode 29. When the electron beams are being directed from the line cathodes 13 toward the G2 electrode 29, the voltages EB, EM and EG1 have roughly equal values. A power supply ES electrically connected to the metal core 25A of the vibration-preventing plate 25 applies a preset potential to the metal core 25A. The potential applied to the metal core 25A is approximately equal to the amplitudes of the voltages EM and EB. In the case where the voltages EM and EB are approximately equal to a ground level, the metal core 25A may be grounded. The application of the potential to the metal core 25A produces a shielding effect which prevents a leakage of the pulse voltages EB from the vertical scanning electrodes 11 into the line cathodes 13 in the form of noise. Accordingly, the signal-to-noise ratio in the electron beam modulation via the line cathodes 13 is improved.

Other portions of the display device according to the fifth embodiment of this invention are similar to those of the display device of FIGS. 1–6.

Figure 15:
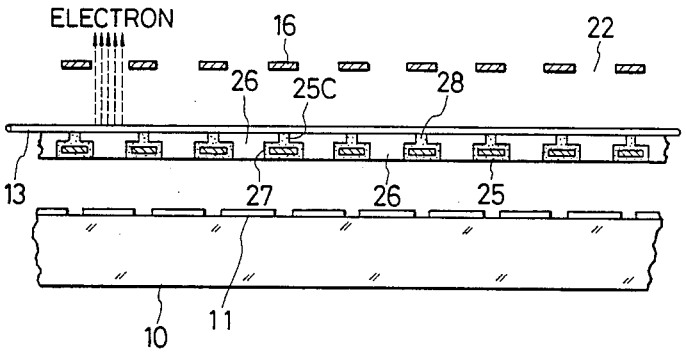
FIG. 15 is a sectional view of part of a display device according to a sixth embodiment of this invention.

FIG. 15 shows a sixth embodiment of this invention which is similar to the embodiment of FIGS. 12–14 except that the vibration-preventing plate 25 has projections **25*c* made of insulating material and forming the support sections 28 in contact with the line cathodes 13. The projections 25*c* have a vertical dimension smaller than the vertical dimension of the bridges 27 between the apertures 26. The insulating layers may be omitted from the portions of the vibration-preventing plate 25 except the projections 25*c***.

Figure 16:
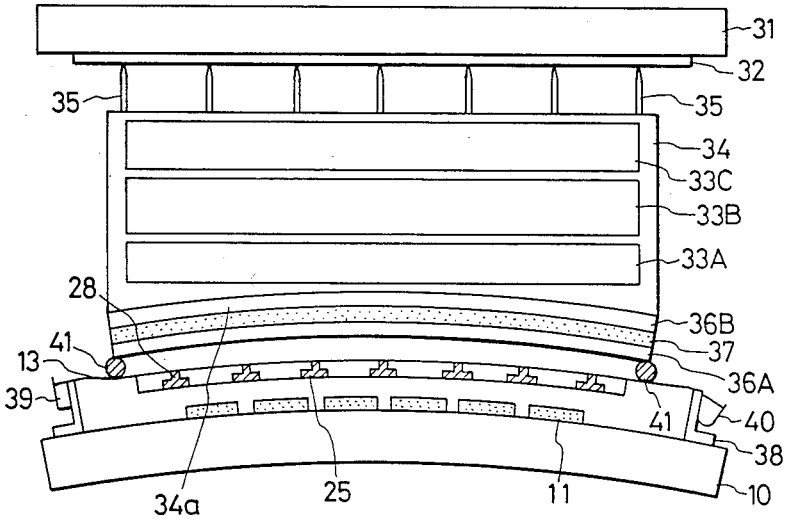
FIG. 16 is a sectional view of part of a display device according to a seventh embodiment of this invention.

FIG. 16 shows a display device according to a seventh embodiment of this invention. As shown in FIG. 16, the display device includes a support member 10 and a faceplate 31 forming portions of a vacuum enclosure. The support member 10 is made of insulating material. Vertical scanning electrodes 11 fixed to an inner surface of the support member 10 extend in parallel and are spaced at regular intervals. As will be made clear hereinafter, various electrodes are held between the support member 10 and the faceplate 31 under atmospheric pressure.

A light emitting layer 32 extending on an inner surface of the faceplate 31 is composed of a phosphor layer and a metal back electrode. Horizontal deflection electrodes 33A, 33B, and 33C are held by a support member 34 made of insulating material and secured to the vacuum enclosure. Parallel support bars 35 extending between the light emitting layer 32 and the support member 34 determines the distances between the faceplate 31 and the horizontal deflection electrodes 33A–33C and transmits atmospheric pressure from the faceplate 31 to the support member 34.

The support member 34 has a concave surface 34*a* opposing the array of the vertical scanning electrodes 11. A laminated structure extending on the concave surface 34*a* of the support member 34 includes layers of a G2 electrode 36B, a spacer 37, and a G1 electrode 36A. Line cathodes 13 disposed between the G1 electrodes 36A and the array of the vertical scanning electrodes 11 extend in parallel and are spaced at regular intervals. A vibration-preventing plate 25 extends between the array of the line cathodes 13 and the array of the vertical scanning electrodes 11. Spacers (not shown) determine the distance between the G1 electrode 36A and the array of the line cathodes 13. Each of the line cathodes 13 is pulled and held between a fixing member 39 and a spring 40 mounted on a base 38 secured to the support member 10. Pressing members 41 in the form of a rod extend along opposite edges of the G1 electrode 36A. The pressing members 41 are made of insulating material such as glass fiber. The pressing members 41 are sandwiched between the G1 electrode 36A and the array of the line cathodes 13. A diameter of the pressing members 41 is larger than the original distance between the array of the line cathodes 13 and the G1 electrode 36A so that the pressing members 41 urge the line cathodes 13 into contact with support projections 28 on the vibration-preventing plate 25. The surfaces of the support projections 28 on the vibration-preventing plate 25 extend in a convex plane so that the line cathodes 13 can be reliably held in contact with the support projections 28. In this way, the vibration-preventing plate 25 supports the line cathodes 13 and prevents vibrations of the line cathodes 13, thereby allowing a high quality of reproduced images. Spacers (not shown) determine the distance between the array of the line cathodes 13 and the array of the vertical scanning electrodes 11.

In general, the G2 electrodes 36B, the spacer 37, the G1 electrode 36A, the vibration-preventing plate 25, and the support member 10 are flat or straight under original conditions. In an evacuation process during manufacture, the atmopheric pressure causes these elements to be curved in correspondence with the concave surface 34*a* of the support member 34.

Other portions of the display device according to the seventh embodiment of this invention are similar to those of the display device of FIGS. 1–6.

The G2 electrode 36B, the spacer 37, the G1 electrode 36A, the vibration-preventing plate 25, and the supoort member 10 may be curved under original conditions. The pressing members 41 may be omitted. In this case, the fixing members 39 and the springs 40 are disposed so as to extend rearward of the plane where the surfaces of the support projections 28 on the vibration-preventing plate 25 reside. The vibration-preventing plate 25 may be disposed between the G1 electrode 36A and the array of the line cathodes 13. In this case, the design is changed to allow the elements to be curved reversely.

Figure 17:
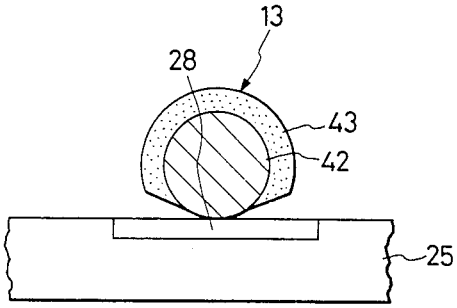
FIG. 17 is a sectional view of part of a display device according to an eighth embodiment of this invention.

FIG. 17 shows an eighth embodiment of this invention which is similar to the embodiment of FIG. 16 except for design changes described hereinafter. Each of line cathodes 13 is composed of a metal wire 42 coated with a layer 43 of oxide material. The oxide layer 43 is previously removed from the surfaces of the metal wire 42 which will meet the support sections 28 of the vibration-preventing plate 25. Accordingly, the oxide layer 43 is prevented from falling off when the line cathode 13 comes into contact with the vibration-preventing plate 25.

What is claimed is:

1. A display device comprising:

(a) line cathodes;

(b) separate first electrodes extending in rear of the line cathodes;

(c) a second electrode extending in front of the line cathodes and having apertures for guiding electron beams from the line cathodes, the apertures of the second electrode corresponding to the separate first electrodes and the line cathodes;

(d) a third electrode deflecting the electron beams;

(e) a screen exposed to the electron beams;

(f) a plate extending along the line cathodes and having apertures corresponding to the separate first electrodes and the line cathodes, the plate having portions between the apertures of the plate, said portions being in contact with the line cathodes; and (g) a vacuum enclosure containing the above-recited components therein.

2. The display device of claim 1 wherein the separate first electrodes are in an elongated form extending perpendicular to the line cathodes, and wherein the plate extends between an array of the separate first electrodes and an array of the line cathodes.

3. The display device of claim 2 further comprising protective members extending between the separate first electrodes, the protective members being connected to the plate.

4. The display device of claim 1 wherein the plate includes a metal core and an insulating layer covering at least part of the metal core opposing the line cathodes.

5. The display device of claim 3 wherein the protective members include insulating members extending between the separate first electrodes and having a large thickness.

6. The display device of claim 2 wherein the plate has projections extending into regions between the separate first electrodes, and wherein the plate includes a metal core coated with an insulating layer.

7. The display device of claim 1 wherein the plate includes a board of insulating material.

8. The display device of claim 1 wherein the plate has a flat surface in contact with the line cathodes.

9. The display device of claim 1 wherein a pitch of points of contact between the line cathodes and the plate is equal to a pitch of the separated first electrodes multiplied by a given number.

10. The display device of claim 1 wherein the apertures in the plate are stepped, having wide ends near the line cathodes and having narrow portions where the plate and the line cathodes are in contact.

11. The display device of claim 1 wherein the apertures in the plate are tapered, having wide ends near the line cathodes and having narrow portions where the plate and the line cathodes are in contact.

12. The display device of claim 1 wherein the plate has projections in contact with the line cathodes.

13. The display device of claim 1 wherein the plate has surfaces extending in a curved plane and contacting the line cathodes.

14. The display device of claim 13 wherein the plate is curved by atmospheric pressure.

15. The display device of claim 1 wherein the plate extends between an array of the line cathodes and the second electrode.

16. The display device of claim 2 wherein the plate forms a spacer determining a distance between an array of the line cathodes and an array of the separate first electrodes.

17. The display device of claim 15 wherein the plate forms a spacer determining a distance between the array of the line cathodes and the second electrode.

18. The display device of claim 2 wherein the plate is directly disposed on the separate first electrodes.

19. The display device of claim 15 wherein the plate is directly disposed on the second electrode.

20. The display device of claim 1 wherein each of the line cathodes includes a metal wire coated with a layer of oxide material, said oxide layer being previously removed from portions of the metal wire which meet the line cathodes.

21. The display device of claim 1 wherein the plate includes an electrically-conductive member and an insulating member fixed to the electrically-conductive member and contacting the line cathodes, and further comprising means for applying a given potential to the electrically-conductive member.

22. The display device of claim 21 wherein the potential applied to the electrically-conductive member is essentially equal to at least one of potentials at the line cathodes and the second electrode.

23. The display device of claim 4 wherein the insulating layer having a large thickness at positions confronting the regions between the separate first electrodes.

24. A display device for mounting in a vacuum enclosure containing a display screen comprising:

(a) first electrodes;

(b) a second electrode;

(c) line cathodes extending between an array of the first electrodes and the second electrode; and (d) a vibration-preventing plate contacting the line cathodes and supporting the line cathodes to prevent vibrations of the line cathodes, the vibration-preventing plate having portions in contact with the line cathodes and having apertures therein corresponding to the first electrodes and line cathodes.

25. The display device of claim 24 wherein the first electrodes comprise vertical scanning electrodes, and wherein the vibration-preventing plate has apertures in positions corresponding to the vertical scanning electrodes and the line cathodes.

26. The display device of claim 25 wherein a pitch of points of contact between the vibration-preventing plate and the line cathodes is equal to a pitch of the vertical scanning electrodes multiplied by a given number.

27. The display device of claim 24 wherein the vibration-preventing plate forms a spacer determining a distance between an array of the line cathodes and the array of the first electrode.

28. The display device of claim 24 wherein the vibration-preventing plate is directly provided on the first electrodes.

29. The display device of claim 24 wherein the first electrodes comprise vertical scanning electrodes, and wherein a pitch of points of contact between the line cathodes and the vibration-preventing plate is equal to a pitch of the vertical scanning electrodes multiplied by a given number.

30. The display device of claim 25 wherein the vertical scanning electrodes are the separate electrodes in an elongated form extending perpendicular to the line cathodes, and wherein the vibration-preventing plate extends between an array of the separate electrodes and an array of the line cathodes.

31. The display device of claim 30 further comprising protective members extending between the separate electrodes, the protective members being connected to the vibration-preventing plate.

32. The display device of claim 24 wherein the vibration-preventing plate includes a metal core and an insulating layer covering at least part of the metal core opposing the line cathodes.

33. The display device of claim 31 wherein the protective members include insulating members extending between the separate electrodes and having a large thickness.

34. The display device of claim 30 wherein the vibration-preventing plate has projections extending into regions between the separate first electrodes, and wherein the plate includes a metal core coated with an insulating layer.

35. The display device of claim 24 wherein the vibration-preventing plate includes a board of insulating material.

36. The display device of claim 25 wherein the apertures are stepped, having wide ends near the line cathodes and having narrow portions where the plate and the line cathodes are in contact.

37. The display device of claim 25 wherein the apertures in the plate are tapered, having wide ends near the line cathodes and having narrow portions where the plate and the line cathodes are in contact.

38. The display devive of claim 24 wherein the vibration-preventing plate has projections in contact with the line cathodes.

39. The display device of claim 24 wherein the vibration-preventing plate has surfaces extending in a curved plate and contacting the line cathodes.

40. The display device of claim 39 wherein the vibration-preventing plate is curved by atmospheric pressure which is applied to a vacuum enclosure.

41. The display device of claim 24 wherein the plate extends between an array of the line cathodes and the second electrode.

42. The display device of claim 41 wherein the plate forms a spacer determining a distance between the array of the line cathodes and the second electrode.

43. The display device of claim 42 wherein the plate is directly disposed on the second electrode.

44. The display device of claim 24 wherein each of the line cathodes includes a metal wire coated with a layer of oxide material, said oxide layer being previously removed from portions of the metal wire which meet the line cathodes.

45. The display device of claim 24 wherein the vibration-preventing plate includes an electrically-conductive member and an insulating member fixed to the electrically-conductive member and contacting the line cathodes, and further comprising means for applying a given potential to the electrically-conductive member.

46. The display device of claim 45 wherein the potential applied to the electrically-conductive member is essentially equal to at least one of potentials at the line cathodes and the second electrode.

47. A display device comprising:

(a) line cathodes extending in a vertical direction and spaced along a horizontal direction;

(b) elongated vertical scanning electrodes extending in the horizontal direction and spaced along the vertical direction, the vertical scanning electrodes extending in rear of the line cathodes;

(c) a grid electrode extending in front of the line cathodes and having apertures for guiding electron beams from the line cathodes;

(d) a vibration-preventing plate having apertures corresponding to the apertures of the grid electrode, the vibration-preventing plate having portions between the apertures of the plate, said portions being in contact with the line cathodes;

(e) a horizontal deflection electrode extending in front of the grid electrode and deflecting the electron beams;

(f) a faceplate;

(g) a light emitting layer extending on an inner surface of the faceplate and exposed to the electron beams; and (h) a vacuum enclosure containing the above-recited components therein.

48. The display device of claim 47 wherein the line cathodes, the vertical scanning electrodes, the grid electrode, and the vibration-preventing plate are curved in similar manners.

49. The display device of claim 48 further comprising a support member holding the horizontal deflection electrode and having a surface which opposed the line cathodes and which is curved in correspondence with the curved arrangement of the line cathodes, the vertical scanning electrodes, the grid electrode, and the vibration-preventing plate.

* * * * *